US005931395A

United States Patent [19]

Sullivan

[11] Patent Number: 5,931,395

[45] Date of Patent: Aug. 3, 1999

[54] VALVE FOR WATER DRIVEN WASTE DISPOSAL APPARATUS

[75] Inventor: Donald J. Sullivan, Sandwich, Ill.

[73] Assignee: Environmental Systems & Solutions, Inc., Draper, Utah

[21] Appl. No.: 09/191,738

[22] Filed: Nov. 13, 1998

[51] Int. Cl.[6] ..... B02C 18/42

[52] U.S. Cl. ..... 241/46.013; 241/46.04; 241/46.06; 241/46.17; 241/257.1

[58] Field of Search ..... 241/46.01, 46.013, 241/46.04, 46.06, 46.17, 100.5, 101.2, 257.1; 91/308, 318, 327, 339; 92/120, 121

[56] References Cited

U.S. PATENT DOCUMENTS

| | | | |
|---|---|---|---|
| 1,155,998 | 10/1915 | Domizi | 91/339 |
| 1,952,690 | 3/1934 | Strom, Sr. | 91/308 |
| 2,070,720 | 2/1937 | Ernst | 91/308 |
| 2,428,420 | 10/1947 | Green | 241/257.1 |
| 2,537,680 | 1/1951 | Kupiec et al. | 91/318 |
| 2,950,065 | 8/1960 | Smith et al. | 241/257.1 |
| 3,700,178 | 10/1972 | Verley . | |
| 3,788,564 | 1/1974 | Kokorzycki | 241/46.014 |
| 4,082,229 | 4/1978 | Boosman . | |
| 4,183,470 | 1/1980 | Hovartos et al. | 241/46.17 X |
| 4,399,947 | 8/1983 | Spelber et al. . | |
| 4,405,159 | 9/1983 | Spelber . | |
| 4,553,560 | 11/1985 | Tucker et al. . | |
| 4,573,642 | 3/1986 | Spelber . | |

*Primary Examiner*—John M. Husar
*Attorney, Agent, or Firm*—Thorpe, North & Western, L.L.P.

[57] ABSTRACT

A water powered waste disposal apparatus has an improved valve with floating seals and water passages. The disposal apparatus has a plurality of cutters disposed in a passageway for cutting waste. A reciprocating piston is driven by pressurized water in an annular chamber. The piston is coupled to at least one rotatable cutter. The valve has a reciprocating control piston for selectively diverting the pressurized water into the annular chamber on alternate sides of the drive piston. The floating seals have slots formed therethrough for allowing the seals to expand and prevent water from leaking past the control piston and preserving pressure. A reciprocating pilot piston selectively conveys the pressurized water to alternate sides of the control piston in response to water pressure in the annular chamber. Water passages are formed at the ends of the control piston to allow the water to act on the control piston. A detent and spring apply an amount of resistance to the pilot piston such that water pressure in the annular chamber must reach a certain threshold pressure to overcome the resistance of the detent and spring. An adjustment mechanism adjusts the amount of resistance applied by the detent to the pilot piston.

27 Claims, 11 Drawing Sheets

VALVE FOR WATER DRIVEN WASTE DISPOSAL APPARATUS

BACKGROUND OF THE INVENTION

1. The Field of the Invention

The present invention relates to a water powered waste disposal unit with an improved control valve. More particularly, the control valve has a reciprocating control piston disposed in a cylinder with floating seals to prevent leaking and indentations in the piston head or cylinder head to prevent stalling.

2. The Background Art

Waste disposal units disposed under sinks have become commonplace. The waste disposal unit cuts or shreds waste, such as table scraps, so that the waste may pass through pipes of a house plumbing system without clogging the pipes. The disposal units provide the convenience of simply washing waste directly into the sink without having to first wipe the waste into a trash receptacle or having to later clear the waste from a drain in the sink. Disposal units are typically mounted under the sink between the drain in the bottom of the sink and the pipes of the plumbing system and typically have cutters disposed in the units and coupled to electric motors to cut the waste as it passes through the units.

Despite the conveniences provided by these waste disposal units, there are several disadvantages, one of which is the need for electrical wiring to operate the motor. Because of this, the devices are difficult to install and pose a danger of coupling an electric source to the water and plumbing system. Another disadvantage is the low starting torque of the electric motors. Waste initially disposed in the unit may stall the motor. Thus, the motor may burn out or pose a danger of injury as a user reaches into the unit to remove the clogged waste.

U.S. Pat. Nos. 3,700,178, issued Oct. 24, 1972, to Verley, and 4,082,229, issued Apr. 4, 1978, to Boosman, disclose water powered waste disposal units. The units have a housing defining an annular chamber around the unit. A reciprocating drive piston is slidingly disposed in the chamber and is coupled to a pivoting cutter in the housing. A valve alternately directs pressurized water into the annular chamber on opposite sides of the drive piston to drive the piston, and thus the cutter, in a reciprocal rotating motion.

U.S. Pat. No. 4,399,947, issued Aug. 23, 1983, to Spelber et al. discloses a valve for directing the water for a water powered disposal unit. The valve has a reciprocating control piston slidingly disposed in a valve housing. The control piston has a channel formed therein for alternately directing water into the annular chamber on either side of the drive piston as the control piston reciprocates in the valve housing. The valve also has a reciprocating pilot piston slidingly disposed in the housing. The pressure in the annular chamber forces the pilot piston to reciprocate. The pilot piston has a chamber formed therein for alternately directing water to opposite sides of the control piston as the pilot piston reciprocates, thus forcing the control piston to reciprocate.

A detent is disposed in the housing and engages the pilot piston. A spring biases the detent against the pilot piston so that the detent and spring apply an amount of resistance to the pilot piston. The water pressure developed in the annular housing must overcome the amount of resistance applied by the detent to the pilot piston in order to cause the pilot piston to reciprocate.

Despite advantages presented by the above-described water powered waste disposal units, there are also disadvantages. One such disadvantage is the high tolerances required to obtain consistent, efficient performance. Any leaks in the system result in pressure variations which may or may not be sufficient to properly operate the unit. For example, any leaks around the control piston result in water escaping from the control cavity and a loss of pressure at the drive piton. Thus, the unit may be inefficient and inoperable. Another disadvantage is that the control piston tends to stall of stick at the end of its travel. These drawbacks have prevented the substantial advantages of the water powered waste disposal units from being enjoyed.

Therefore, it would be advantageous to develop a water powered waste disposal apparatus, and/or valve for such an apparatus, capable of consistent efficient operation. It would also be advantageous to develop such a disposal apparatus and valve capable of preventing leaks and the resulting loss of pressure. It would also be advantageous to develop such a disposal apparatus and valve capable of preventing stalling, or halted operation.

OBJECTS AND SUMMARY OF THE INVENTION

It is therefore an object of the present invention to provide a water powered waste disposal apparatus with a valve for consistent and efficient operation.

It is another object of the present invention to provide such a water powered waste disposal apparatus with a valve for efficiently utilizing the water pressure to develop the most torque.

It is another object of the present invention to provide such a water powered waste disposal apparatus with a valve which prevents leaking about the control piston.

It is another object of the present invention to provide such a water powered waste disposal apparatus with a valve which prevents stalling or sticking.

The above objects and others not specifically recited are realized in a specific illustrative embodiment of a water powered waste disposal apparatus with an improved valve for preventing leaking and stalling. The apparatus has a housing with a waste inlet, an outlet, and a passage extending therebetween. A plurality of cutters are disposed in the passage of the housing for cutting the waste. At least one cutter is pivotally or rotationally disposed in the passageway.

The housing also defines an annular chamber formed around or circling the passage. The housing also has first and second water openings formed therein in fluid communication with the annular chamber. The first and second water openings allow water into and out of the annular chamber. A reciprocating drive piston is slidably disposed in the annular chamber and coupled to the at least one pivoting cutter to cause the pivoting cutter to pivot as the drive piston moves within the annular chamber.

The valve has a valve housing coupled to a source of pressurized water and to the first and second water openings of the housing to alternately direct the pressurized water to the first and second water openings, and thus drive the drive piston in a reciprocal manner. A reciprocating control piston is slidably disposed in a control cylinder of the valve housing between first and second control positions. The control cylinder has a cylindrical wall and opposite first and second control cylinder ends. The control piston has opposite first and second control piston ends. The control piston also has an annular notch or a control channel formed therein for directing the pressurized water. As the control piston reciprocates between the first and second control positions, it alternately directs the pressurized water to the first and second openings, thus driving the drive piston in a reciprocal rotational motion.

A water passageway advantageously is formed between the first end of the control piston and the first end of the control cylinder, and between the second end of the control piston and the second end of the control cylinder. The water passageway may be formed by an indentation formed in a surface of each control piston end. Alternatively, the water passageway may be formed by an indentation in a surface of each control cylinder end. Alternatively, a protrusion may be formed on either or both of the control piston and control cylinder ends. The water passageway advantageously allows water between the piston and cylinder ends so that the pressurized water may act on the control piston.

The control piston advantageously has a pair of dams extending radially from the piston towards the wall of the cylinder. The control channel is formed between the pair of dams. Each dam has an annular groove and a floating seal disposed in the groove to prevent water from leaking from the control channel. Each seal has a slot cut through the seal to allow the seal to expand radially and seal against the inner surface of the control cavity. The slow preferably is cut at approximately 41 degrees forming two end of the seal to allow the ends to seal against each other.

A reciprocating pilot piston is slidably disposed in the valve housing between first and second pilot positions. The pilot piston has opposite sides and an annular notch or a pilot channel formed therein for directing the pressurized water. As the pilot piston reciprocates between the first and second pilot positions, it alternately directs the pressurized water to the opposite sides of the control piston, thus driving the control piston in a reciprocal motion.

The valve housing has first and second passageways formed therein and extending between the opposite sides of the pilot piston and the first and second openings. Water pressure is communicated from the annular chamber to the pilot piston to reciprocate the pilot piston. A detent engages the pilot piston and applies an amount of resistance to movement of the pilot piston between the first and second pilot positions. A spring may bias the detent against the pilot piston. Thus, the water pressure in the annular chamber, and thus at the opposite sides of the pilot piston, must reach a certain threshold pressure in order to overcome the amount of resistance applied by the detent and move the pilot piston.

The amount of resistance applied by the detent may be adjusted by an adjustment member. The adjustment member may movably engage the spring, thus adjusting the amount of resistance applied by the detent. Therefore, the torque of the disposal apparatus, or the at least one cutter, may be adjusted. In addition, the operating pressure requirement may be adjusted.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
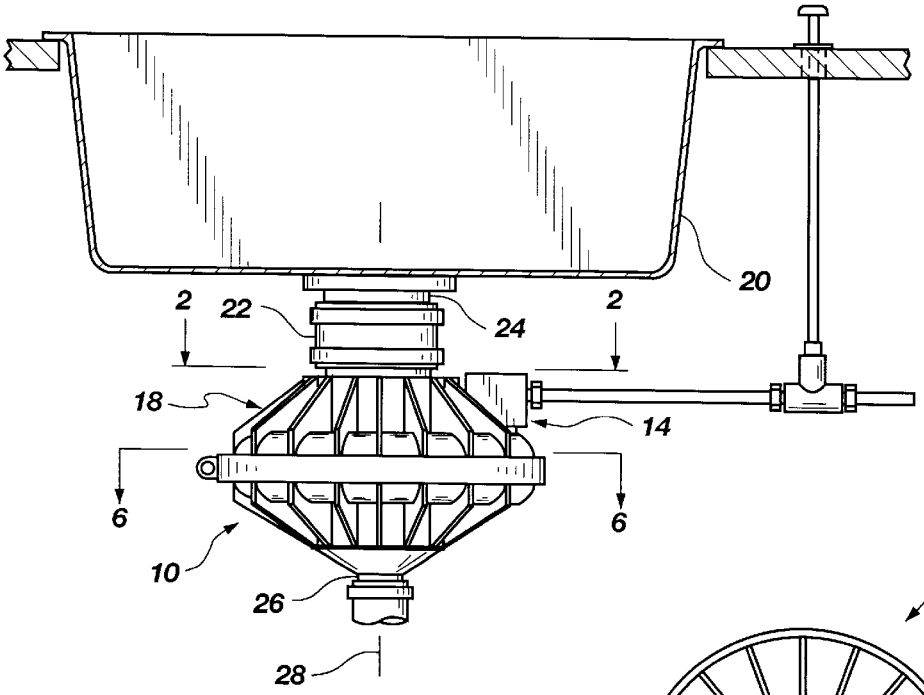
FIG. 1 is a side view of a water powered waste disposal apparatus with an adjustable valve in accordance with the principles of the present invention coupled to a sink and source of pressurized water.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
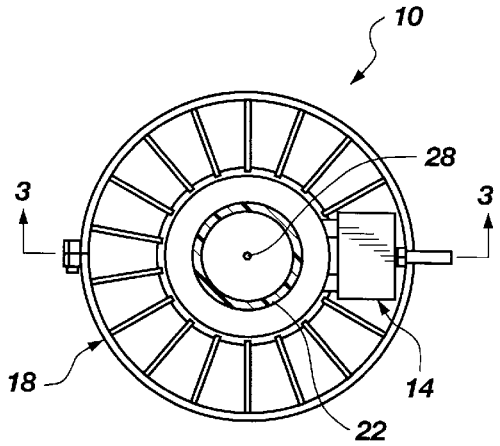
FIG. 2 is a top view of the water powered waste disposal apparatus in accordance with the principles of the present invention.
Figure 3:
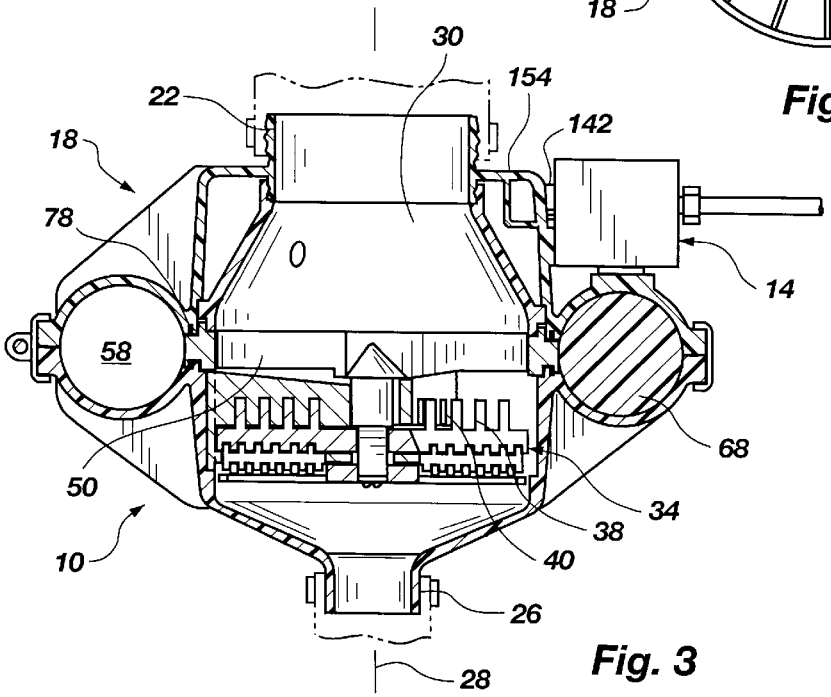
FIG. 3 is a side, cross-sectional view of the water powered waste disposal apparatus of FIG. 2, taken along section 3—3.

Referring to FIGS. 1–3, a water powered waste disposal apparatus, indicated generally at 10, is shown for cutting waste. In addition, an improved valve, indicated generally at 14, with improved performance characteristics of the present invention is shown for directing pressurized water. The apparatus 10 has an apparatus housing 18 adapted for being disposed under a sink 20, as shown in FIG. 1. The housing 18 has a waste inlet 22 disposed generally at the top of the housing 18 for allowing the waste into the housing 18. The housing 18 and/or inlet 22 may be configured for being coupled to a drain 24 of a sink 20, as shown in FIG. 1. The housing 18 also has an outlet 26 disposed generally at the bottom of the housing 18 for allowing the waste out of the housing 18. The housing 18 may have a longitudinal axis 28 extending vertically between the inlet 22 and outlet 26.

Referring to FIG. 3, the housing 18 also defines a waste passage 30 formed in the housing 18 and extending between the waste inlet 22 and the outlet 26. The passage 30 may be concentric with the longitudinal axis 28 of the housing 18 and have a circular cross section.

Figure 4:
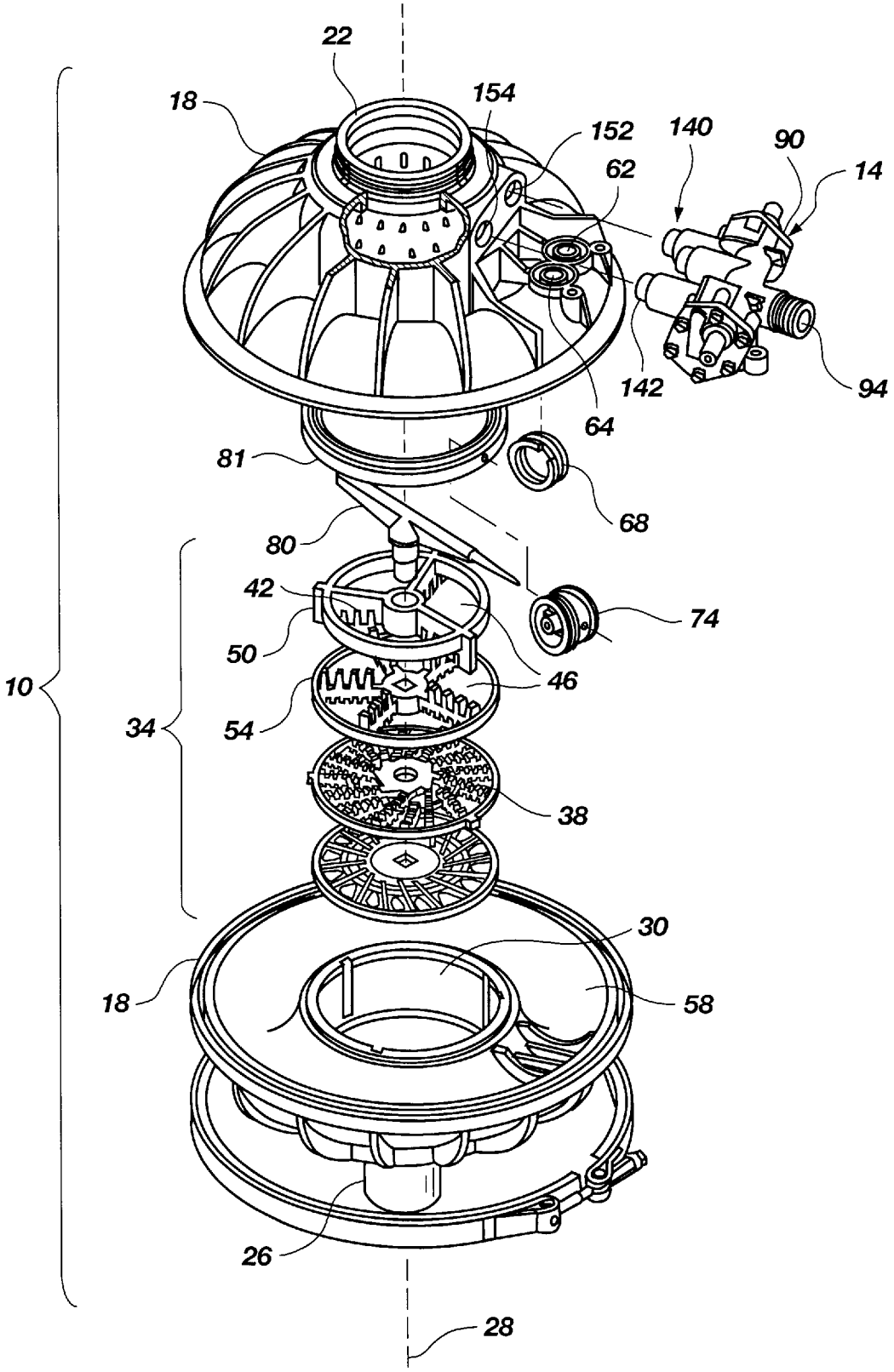
FIG. 4 is an exploded view of the water powered waste disposal apparatus in accordance with the principles of the present invention.

Referring to FIGS. 3 and 4, a plurality of cutters 34 are disposed in the passage 30. The cutters 34 may be arranged in layers, or may be stacked. The cutters 34 are preferably the same shape as the passage 30. Thus, the cutters 34 may be circular. The cutters 34 may be plates and have blades 38 or portions which protrude and interlock with grooves 42 formed in adjacent cutters 34. The cutters 34 have a plurality of openings 46 formed therein for permitting the waste to pass through the cutters 34, as shown in FIG. 4.

Some of the cutters 50 may be secured, or fixedly disposed, to the housing 18 or passage 30. At least one cutter is a pivoting or rotating cutter 54 pivotally or rotatably disposed in the passage 30. The pivoting cutter 54 pivots about the longitudinal axis 28 of the housing 18. The blades 38 and grooves 42 of the adjacent cutters 50 and 54 inter-couple. As the waste passes through the openings 46 in the cutters 34, the waste is cut between the pivoting cutters 54 and the fixed cutters 50.

Figure 5A:
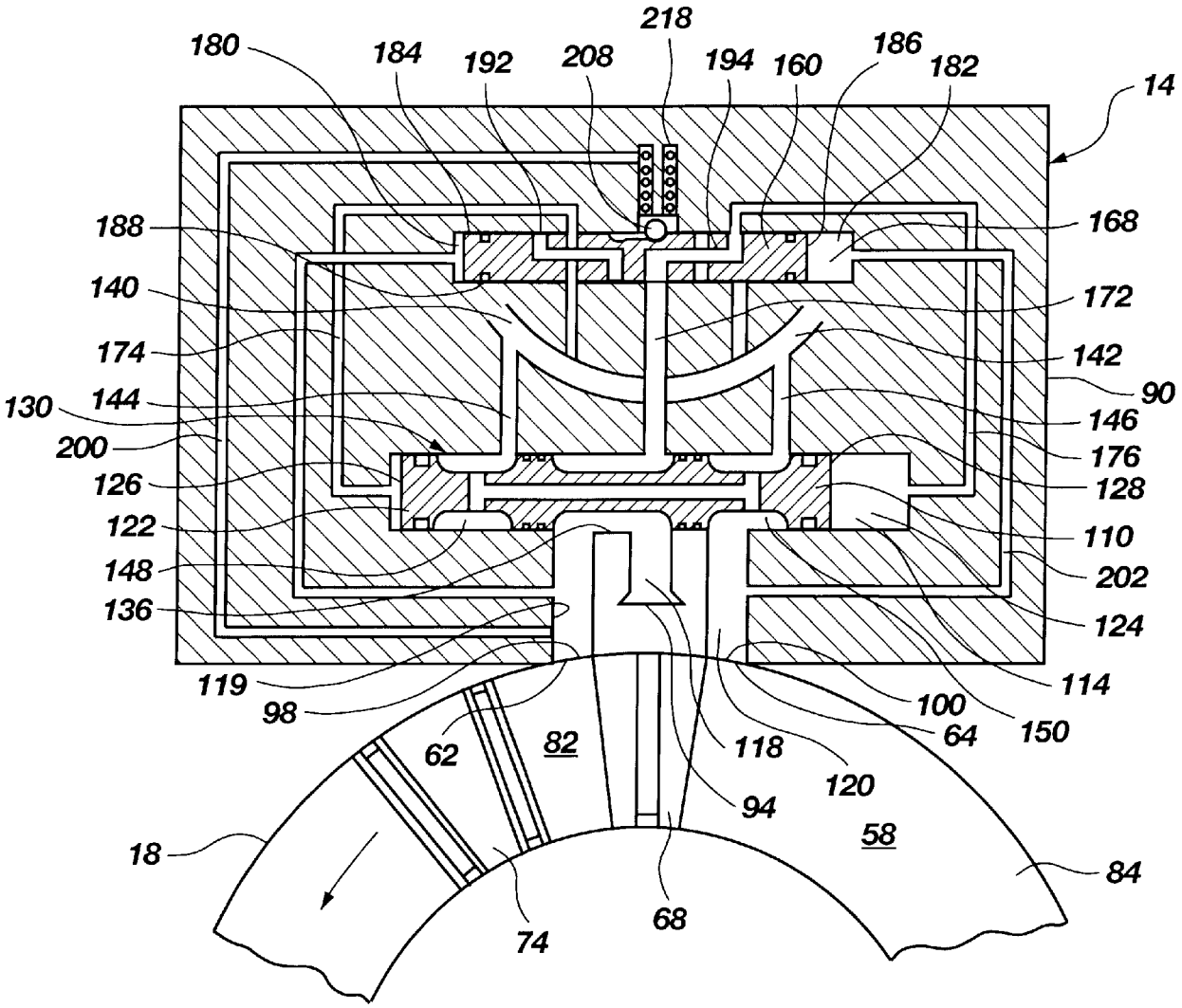
FIG. 5*a* is a schematic view of the water powered waste disposal apparatus and adjustable valve in accordance with the principles of the present invention.
Figure 5B:
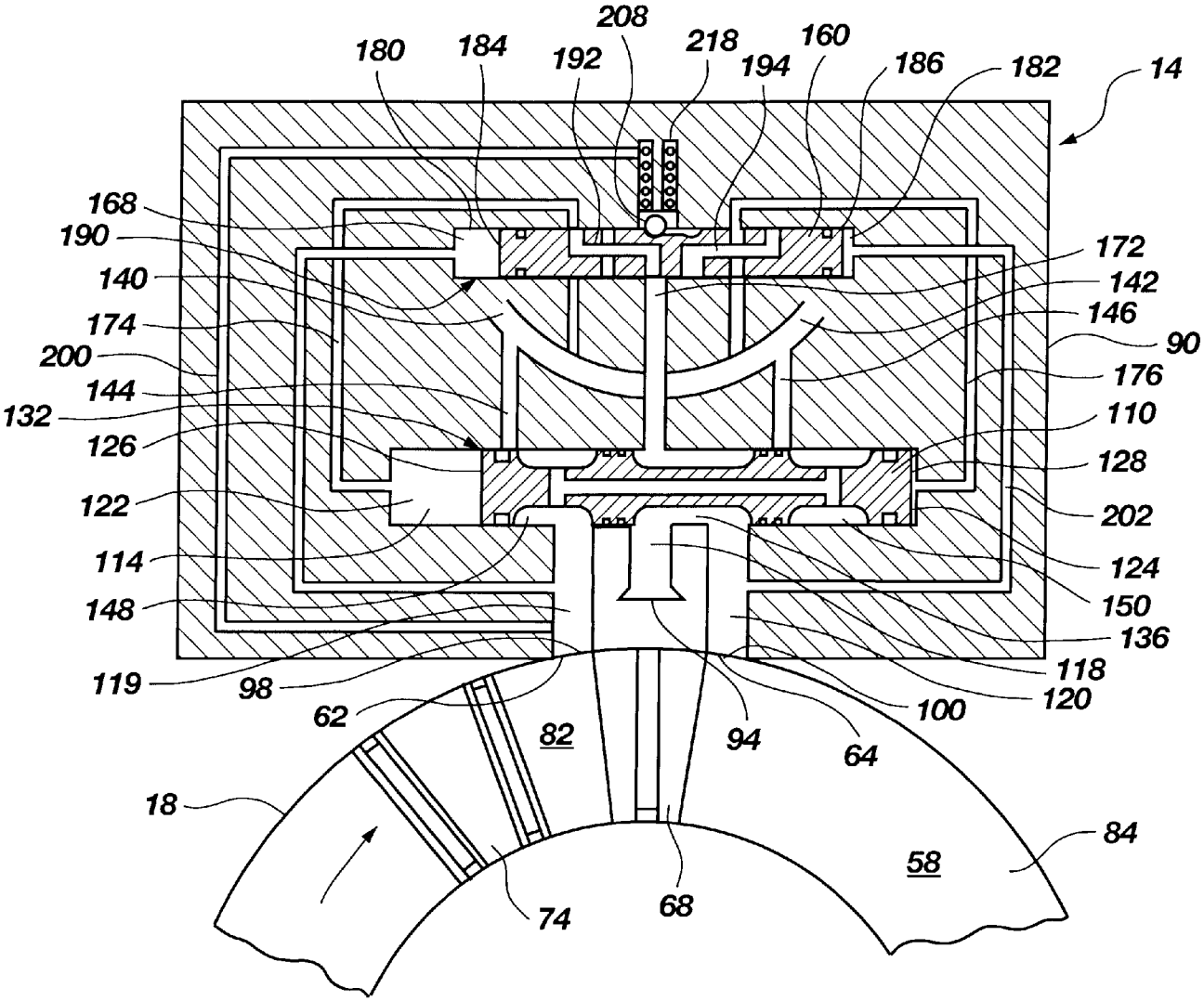
FIG. 5*b* is a schematic view of the water powered waste disposal apparatus and adjustable valve in accordance with the principles of the present invention.

Referring to FIGS. 3 and 4, the housing 18 also defines an annular chamber 58 formed about the passage 30 or the longitudinal axis 28. The annular chamber 58 has a torus or donut shape and preferably has a circular cross section. Referring to FIGS. 4, 5*a* and 5*b*, the housing 18 has first and second water openings 62 and 64, or left and right openings, formed therein which extend into the annular chamber 58. The first and second water openings 62 and 64 are located relatively close together with a small space in between them. The first and second water openings 62 and 64 allow water into, or out of, the annular chamber 58.

A plug or stop 68 is disposed in the annular chamber 58 between the first and second water openings 62 and 64, or at the small space between the first and second water openings. The water openings 62 and 64 are located relatively close to the plug 68, with one of the water openings 62 and 64 being located on one side of the plug 68. The plug 68 has the same cross section as the annular chamber 58, such as circular. In addition, the plug 68 has a perimeter or edge which seals against an inner wall of the annular chamber 58.

A reciprocating drive piston 74 is slidably disposed in the annular chamber 58. The drive piston 74 may move or slide within the annular chamber 58 in a rotational motion. The drive piston 74 has the same cross section as the annular chamber 58, such as circular. The drive piston 74 has a perimeter or edge which slidingly seals against the inner wall of the annular chamber 58.

Figure 6:
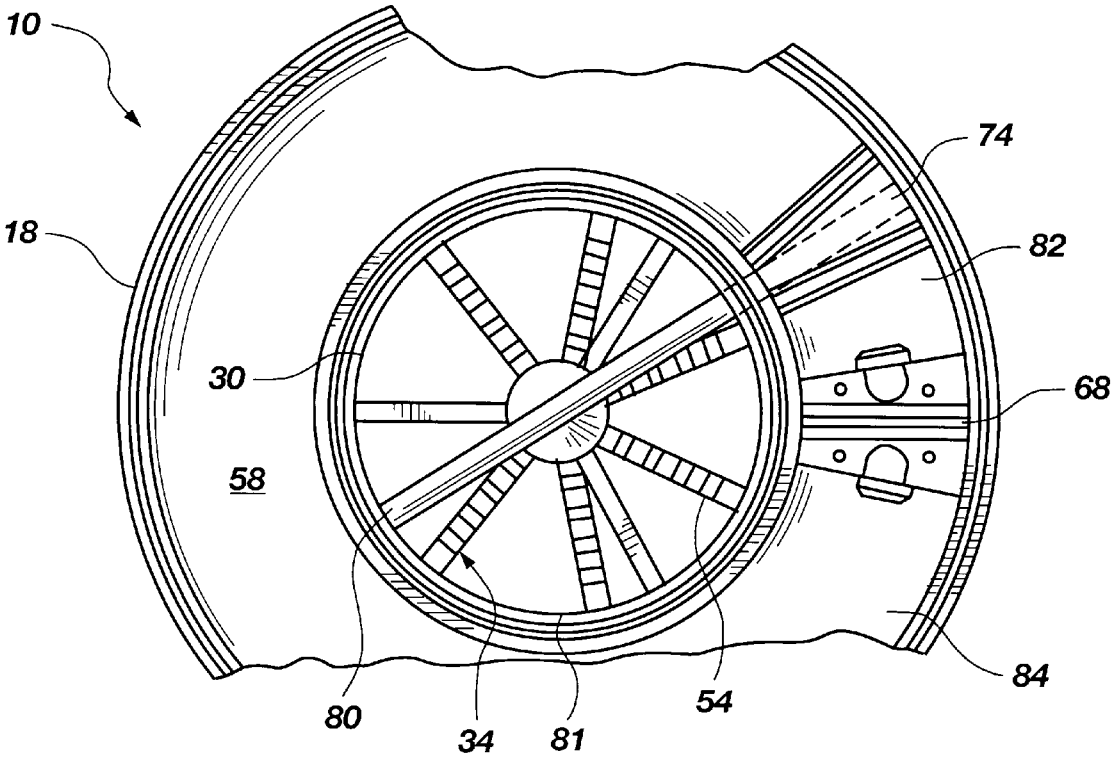
FIG. 6 is a top, cross-sectional view of the water powered waste disposal apparatus of FIG. 1, taken along section 6—6.
Figure 7:
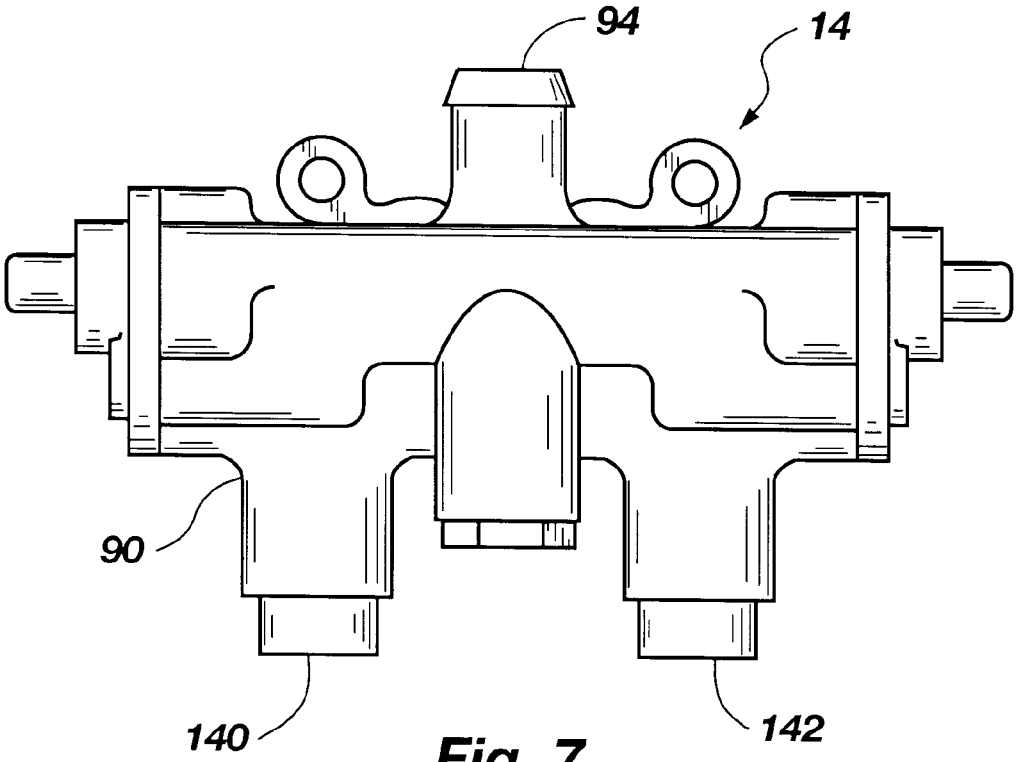
FIG. 7 is a top view of an adjustable valve in accordance with the principles of the present invention.
Figure 8:
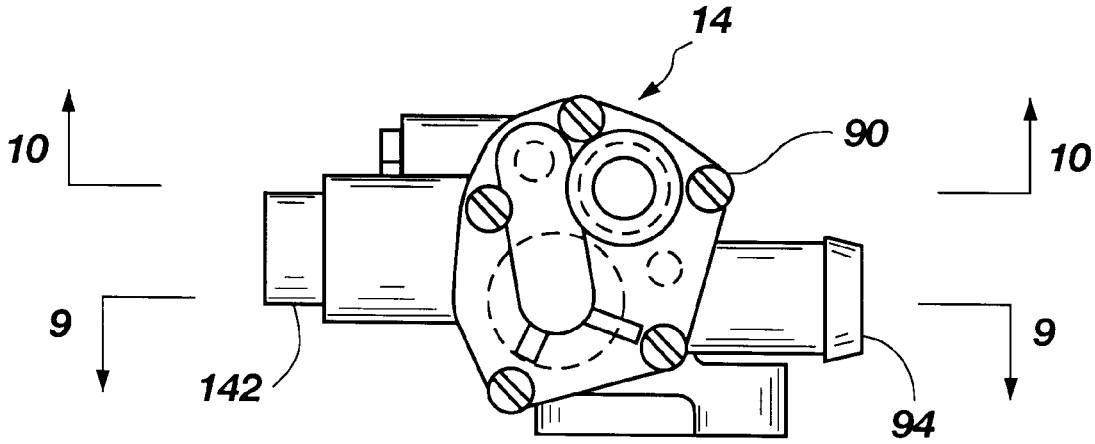
FIG. 8 is a side view of the adjustable valve in accordance with the principles of the present invention.

Referring to FIG. 6, the drive piston 74 is coupled to the pivoting cutter 54. Thus, as the drive piston 74 rotates in the annular chamber 58, it drives or forces the pivoting cutter 54 to pivot in the passage 30 of the housing 18. Referring to FIG. 3, an annular opening 78 is formed in an inner wall of the annular chamber 58 and a wall of the passage 30 so that the opening 78 extends between the passage 30 and annular chamber 58. The drive piston 74 and pivoting cutter 54 couple through the annular opening 78.

Referring to FIGS. 5*a*, 5*b* and 6, the drive piston 74 divides the annular chamber 58 into a first and second chambers 82 and 84, or left and right chambers. The first and second chambers 82 and 84 are arc-shaped, or partially annular. The first and second chambers 82 and 84 are defined by the walls of the annular chamber and the plug 68 on one end and the drive piston 74 on the other end. Thus, the first water opening 62 is formed in the first chamber 82 while the second water opening 64 is formed in the second chamber 84. The drive piston 74 has opposite sides, with one side in communication with the first chamber 82 and the other side in communication with the second chamber 84.

Referring to FIGS. 5*a* and 5*b*, the improved control valve 14 is advantageously coupled to the apparatus housing 18, or the first and second water openings 62 and 64. The control valve 14 supplies pressurized water from a source of pressurized water alternatively to the first and second water openings 62 and 64, and thus to first and second chambers 82 and 84, to drive the drive piston 74 in a reciprocal manner.

The valve 14 has a valve housing 90 coupled to the apparatus housing 18. The valve housing 90 has a water inlet 94 for receiving pressurized water and allowing pressurized water into the housing 90. The inlet 94 may be configured for being coupled to a pipe. Thus, the inlet 94 may have a female pipe thread formed therein. Alternatively, the inlet 94 may be configured for being coupled to tubing. Thus, the inlet 94 may have a male barb end.

The valve housing 90 also has first and second water openings 98 and 100. The first and second water openings 98 and 100 of the valve housing 90 are coupled to the first and second water openings 62 and 64 of the apparatus housing 18. The valve housing 90 defines a plurality of channels formed therein for conveying or directing the pressurized water through the housing 90 between the inlet 94 and first and second water openings 98 and 100, as discussed more fully below. The valve housing 90 also has a control cavity or cylinder with opposite ends and pilot cavity with opposite ends as discussed below.

Figure 9A:
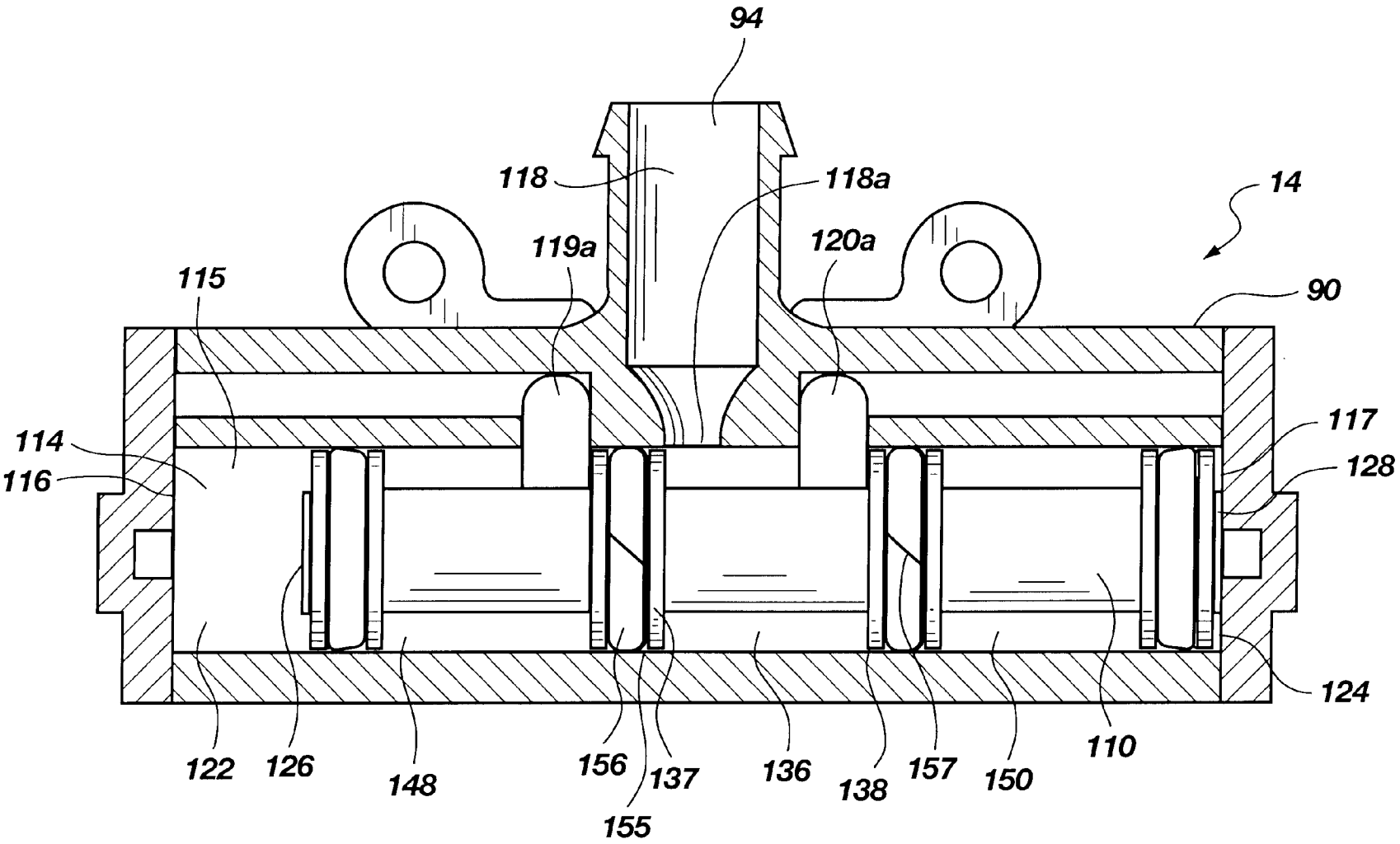
FIG. 9*a* is a top, cross-sectional view of the adjustable valve with floating seals in accordance with the principles of the present invention, taken along section 9—9 of FIG. 8.
Figure 9B:
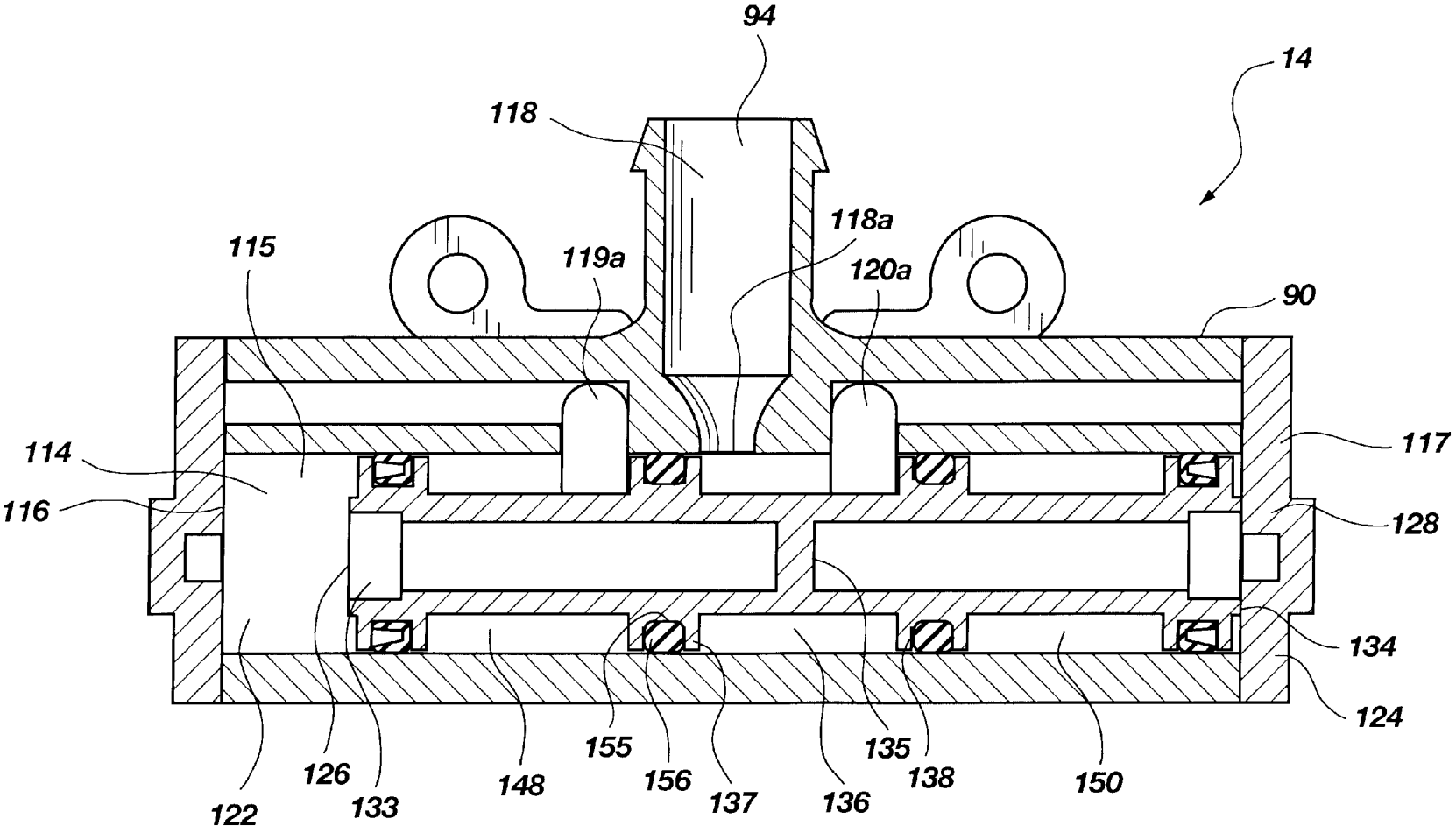
FIG. 9*b* is a top, cross-sectional view of the adjustable valve with floating seals and indentations formed in ends of a control piston in accordance with the principles of the present invention, taken along section 9—9 of FIG. 8.

An improved, reciprocating control piston or spool 110 is slidingly disposed in a control cavity or cylinder 114 formed in the valve housing 90. The control cavity 114 is an elongated cylinder, preferably with a circular cross section, and has a cylindrical control cavity wall 115 and opposite ends, including first and second control cavity ends 116 and 117, as shown in FIGS. 9*a* and 9*b*. The control cavity 114 is in fluid communication with the water inlet 94 through a channel 118 formed in the housing 90. Water enters the control cavity 144 from the channel 118 through an inlet opening 118*a* formed in the control cavity wall 115, as shown in FIGS. 9*a* and 9*b*. The control cavity 114 is also in fluid communication with the first and second water openings 98 and 100 through channels 119 and 120 respectively. Water exits (and enters) the control cavity 114 from the channels 119 and 120 through first and second openings 119*a* and 120*a*, respectively, formed in the control cavity wall 115, as shown in FIGS. 9*a* and 9*b*.

The control piston 110 divides the control cavity 114 into first and second control cavities 122 and 124, or left and right cavities. The control piston 110 has a first end 126 in fluid communication with the first control cavity 122 and a second, opposite end 128 in fluid communication with the second control cavity 124. The control piston 110 is slidable between a first control position, indicated at 130 in FIG. 5*a*, and a second control position, indicated at 132 in FIG. 5*b*. For example, the control piston 110 slides left to the first control position 130 and right to the second control position 132.

The first control piston end 126 and the first control cylinder end 116 have generally opposing surfaces. Likewise, the second control piston end 128 and the second control cylinder end 117 also have generally opposing surfaces. As discussed above, some water powered waste disposal units tend to stall, or stop, at the end of a cycle, or stroke. It is believed that the stalling problem is caused by insufficient force being generated by the water pressure to force the control piston between the first and second control positions. At the end of the stroke of the control piston, or as the control piston reaches the end of travel for either the first or second control positions, the surface of the end of the control piston abuts the surface of the end of the control cylinder in a flush manner. It is believed that the flush abutment of the surfaces prevents the pressurized water from entering between the surfaces to act on the surface of the control piston and force it to move. With the surfaces abutting one another, the water pressure only has a small surface area of the control piston, defined by the opening in the end of the control cylinder, to act upon.

Referring to FIG. 9*a*, the control piston ends 126 and 128 have an indentation 133 formed in the surface to create a fluid passage, indicated at 134, for the pressurized water to enter between the control piston ends 126 and 128, and the control cylinder ends 116 and 117, respectively. The indentation 133 prevents a substantial portion of the surface of the control piston from flush abutment with the surface of the end of the control cavity. The indentation 133 may be a hole or bore formed in the end of the control piston, as shown, which moves the surface, or portion of the surface, as indicated by 135, upon which the pressurized water acts away from the end of the control cylinder.

Figure 9C:
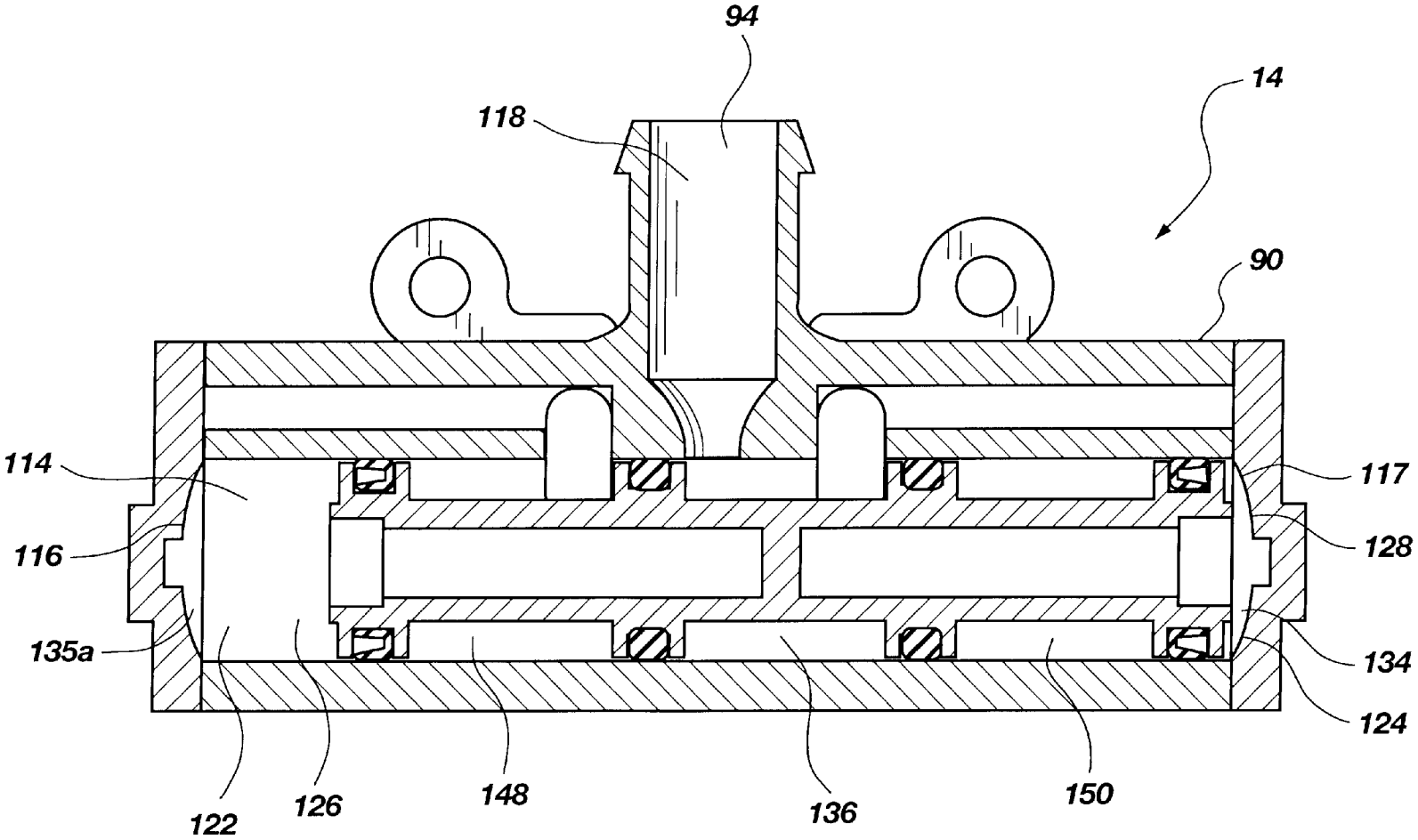
FIG. 9*c* is a top, cross-sectional view of the adjustable valve with indentations formed in end of a control cylinder in accordance with the principles of the present invention.
Figure 9D:
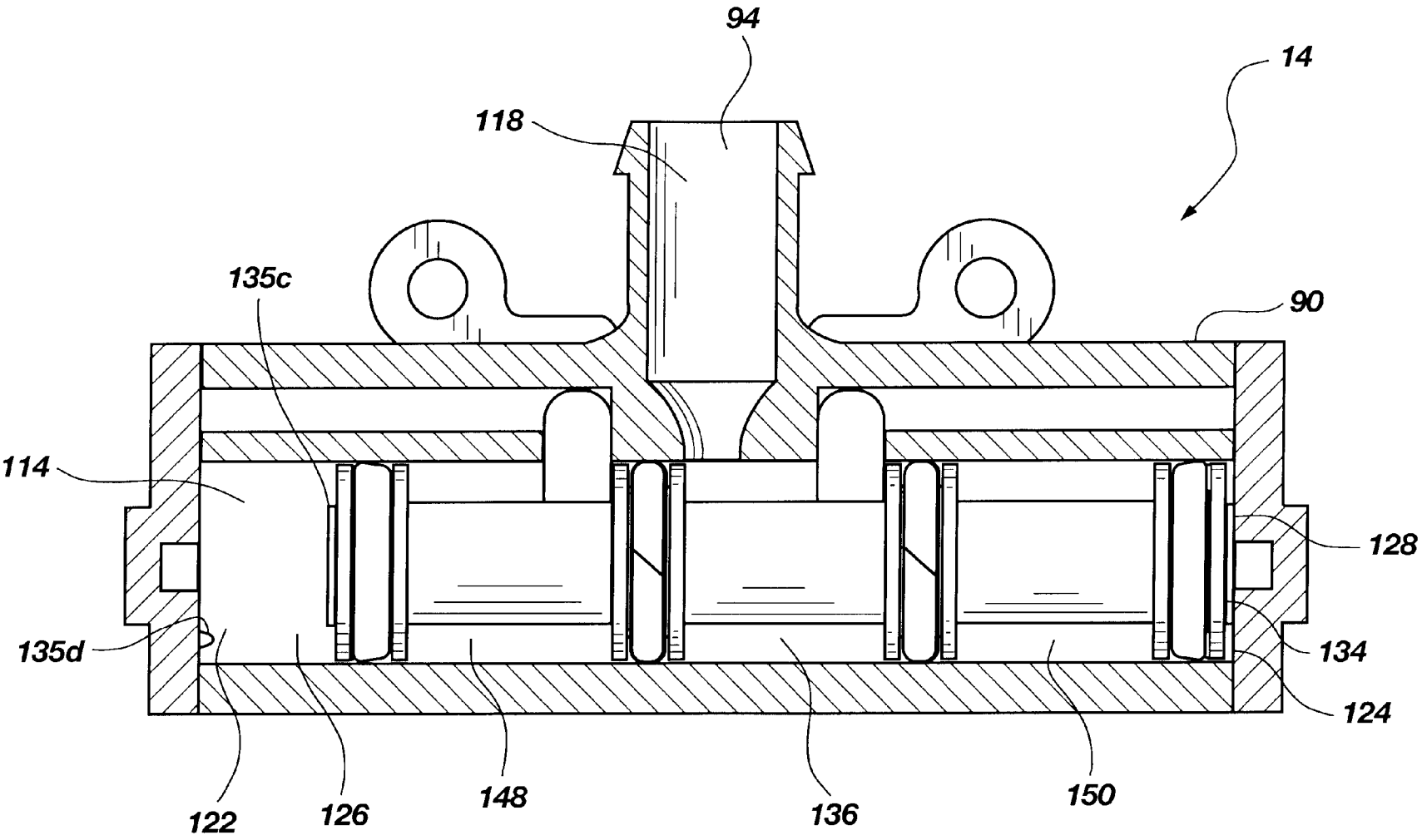
FIG. 9*d* is a top, cross-sectional view of the adjustable valve with protrusions formed at the ends of a control cylinder and the ends of a control piston.

Alternatively, referring to FIG. 9*c*, an indentation 135*a* may be formed in the surface of the ends 116 and 117 of the control cylinder 114. The indentation 135*a* creates the fluid passage 134 between the end of the control piston and the ends of the control cylinder. The indentation 135*a* may be curved and concave, as shown, to prevent flush abutment between the surfaces of the piston and cylinder ends. Alternatively, a protrusion 135*b* may be formed on the ends 126 and 128 of the control piston, or a protrusion 135c may be formed on the ends 116 and 117 of the control cylinder to prevent flush abutment between the ends and to create a fluid passageway 134 between the ends, as shown in FIG. 9*d*.

Referring again to FIGS. 5*a* and 5*b*, the control piston 110 is an elongated member with the same cross section as the control cavity 114, such as circular. The control piston 110 has several portions with perimeters or edges with seals that form a fluid tight seal with an inner surface of the control cavity 114. The control piston 110 has a control channel 136 or annular groove formed therein. Referring to FIG. 5*a*, the control channel 136 conveys or directs water from the water inlet 94, or channel 118, to the first water opening 98, or channel 119, when in the first control position 130. Thus, when the control piston 110 is in the first control position 130, water flows in the water inlet 94, through the channel 118, into the control cavity 114, through the control channel 136, through the channel 119, and to the first water opening 98, and thus into the first annular chamber 82. Referring to FIG. 5*b*, the control channel 136 conveys or directs water from the water inlet 94, or channel 118, to the second water opening 100, or channel 120, when in the second control position 132. Thus, when the control piston 110 is in the second control position 132, water flows in the water inlet 94, through the channel 118, into the control cavity 114, through the control channel 136, through the channel 120, and to the second water opening 100, and thus into the second annular chamber 84. Therefore, the control piston 110 and control channel 136 direct or control the flow of pressurized water to the annular chamber 58 by alternately conveying water into the first and second chambers 82 and 84.

Referring to FIGS. 9*a* and 9*b*, the control piston 110 has several annular dam portions, including first and second spaced apart dams 137 and 138, positioned along the length of the piston 110 between the ends 126 and 128. The first and second dams 137 and 138 have perimeters or edges that extend radially outwardly from the piston 110 towards the wall 115 of the control cylinder 114. The perimeters or edges extend nearly to the wall 115 and the dam portions 137 and 138 have an outer diameter slightly less than a diameter of the cylinder 114. Similarly, the ends 126 and 128 of the control piston 110 also have perimeters or edges that extend nearly to the wall 115 the control cavity 114 and have outer diameters nearly equal to the diameter of the cavity 114.

Between the dam portions the control piston 110 has portion with reduced diameters forming channels. The control channel 136 may be an annular groove formed about the longitudinal axis of the control piston 110 between the first and second dams 137 and 138, as shown. Alternatively, the control channel 136 may be a passage extending through the control piston 110. The control channel 136 is one example of a control channel means for conveying or directing water from the inlet 94 to the first or second openings 98 and 100. It is understood that the control channel 136 may take various forms or shapes.

In addition to conveying the pressurized water into the annular chamber 58, the control piston 110 also directs the flow of water out of the annular chamber 58. The valve housing 90 has first and second exhaust openings 140 and 142. The control cavity 114 is in fluid communication with the first and second exhaust openings 140 and 142 through channels 144 and 146 respectively.

The control piston 110 also has first and second exhaust channels 148 and 150, as shown in FIGS. 9*a* and 9*b*, formed therein to convey water from the first and second chambers 82 and 84. The exhaust channels 148 and 1So may be annular channels formed around the control piston 110, or longitudinal axis thereof. The first exhaust channel 148 may be formed between the first dam 137 and the first control piston end 126, or dam, while the second exhaust channel 150 may be formed between the second dam 138 and the second control piston end 128, or dam. The first and second exhaust channels 148 and 150 are located and positioned within the control piston 110 so that they alternately extend between the first and second water openings 98 and 100 and the first and second exhaust openings 140 and 142. Thus, the exhaust channels 148 and 150 may be located on either side of the control channel 136 forming the first and second dams 137 and 138 therebetween for separating the channels.

While the control piston 110 is in the first control position 130 as shown in FIG. 5*a*, the second exhaust channel 150 extends between the second water opening 100 and the second exhaust opening 142 to allow water to flow out of the second chamber 84. While the control piston 110 is in the second control position 132 as shown in FIG. 5*b*, the first exhaust channel 148 extends between the first water opening 98 and the first exhaust opening 140 to allow water to flow out of the first chamber 82.

Referring to FIG. 4, the first and second exhaust openings 140 and 142 of the valve housing 90 are coupled to first and second exhaust passages 152 and 154 of the apparatus housing 18. Referring to FIG. 3, the first and second exhaust passages 152 and 154 extend through the apparatus housing 18 to the passage 30. The exhaust passages 152 and 154 preferably extend to the waste passage 30 above, or upstream, of the cutters 34. Thus, as water exhausts from the annular chamber 58, it is channeled into the passage 30 where it combines with the waste.

While the control piston 110 is in the second control position 132, as shown in FIGS. 9*a* and 9*b*, the first dam 137 is positioned between the inlet opening 118*a* and the first opening 119*a* in the cylinder wall 115. Similarly, while the control piston 110 is in the first control position 130, as shown in FIG. 5*a*, the second dam 138 is positioned between the inlet opening 118*a* and the second opening 120*a*.

Referring to FIGS. 9*a* and 9*b*, each of the first and second dams 137 and 138 has an annular groove 155 formed therein facing or opening towards the cavity wall 115. An annular floating seal 156 is advantageously disposed in each groove 155 to prevent water from leaking from the control channel 136 and past the dams 137 and 138. Prior water powered waste disposal units tended to operate inconsistently and inefficiently. It is believed that the inconsistent and inefficient performance was due to water leaking at various points along the system which resulted in loss of pressure. It is believed that the major source of leakage was from the control piston. The floating seals of the present invention advantageously prevent leakage and preserve water pressure.

The floating seal 156 advantageously has a cut or slot 157 formed in the seal. The cut 157 divides the annular seal 156 so that the seal 156 has opposing ends that meet. The slow 157 allows the pressurized water to expand the seal 156 against the inner surface or wall 115 of the control cavity 114. Thus, even if the wall or surface 115 of the control cavity 114 is not perfectly circular or cylindrical, or even if there are defects in the surface 115, the slot 157 allows the annular seal 156 to expand and seal against the wall 115 under the force of the pressurized water. As the control piston 110 moves back and forth in the control cavity 114, the seal 156 slides back and forth along the wall 115 of the cavity 114 with the slot allowing the seal 156 to expand and contract as the wall 115 varies in diameter or shape.

In addition, the cut 157 advantageously forms an angle with respect to a plane defined by the seal 156. The cut 157 forms two ends of the seal 156 with angular faces that meet together. The faces abut one another and slide along one another as the seal 156 expands and contracts. The cut 157 allows the faces of the ends to abut and seal against one another to prevent leakage past the seal 156. Preferably, the angle of the cut 157 is approximately 41 degrees. It has been found that angles larger than 41 degrees permit the ends of the seal 156 formed by the cut 157 to feather out, while angles smaller than 41 degrees prevent the ends of the seal 156 formed by the cut 157 from sealing.

Referring again to FIG. 5*b*, a reciprocating pilot piston or spool 160 is slidingly disposed in a control cavity or cylinder 168 formed in the valve housing 90. The pilot piston 160 and pilot cylinder 168 are similar in many respects to the control piston 110 and control cylinder 114. The pilot cavity 168 is an elongated cylinder, preferably with a circular cross section. The pilot cavity 168 has opposite ends. The pilot cavity 168 is in fluid communication with the water inlet 94 through a channel 172 formed in the housing 90. The pilot cavity 168 is also in fluid communication with the control cavity 114, or first and second control cavities 122 and 124, through channels 174 and 176 respectively.

The pilot piston 160 divides the pilot cavity 168 into first and second pilot cavities 180 and 182, or left and right cavities. The pilot piston has a first surface or side 184 in fluid communication with the first pilot cavity 180 and a second opposite surface or side 186 in fluid communication with the second pilot cavity 182. The pilot piston 160 is slidable between a first pilot position, indicated at 188 in FIG. 5*a*, and a second pilot position, indicated at 190 in FIG. 5*b*. For example, the pilot piston 160 slides left to the first pilot position 188 and right to the second pilot position 190.

The pilot piston 160 is an elongated member with the same cross section as the pilot cavity 168, such as circular. The pilot piston 160 has several portions with perimeters or edges that form a fluid tight seal with an inner surface of the pilot cavity 168. The pilot piston 160 has first and second pilot channels 192 and 194 formed therein for conveying or directing water to the channels 174 and 176, and thus the first and second control cavities 122 and 124. Referring to FIG. 5*a*, the first pilot channel 192 conveys water from the water inlet 94, or channel 172, to the first control cavity 122 through the channel 174, when in the first pilot position 188. Thus, when the pilot piston 160 is in the first pilot position 188, water flows in the water inlet 94, through the channel 172, into the pilot cavity 168, through the first pilot channel 192, through the channel 174, and to the first control cavity 122. Referring to FIG. 5*b*, the second pilot channel 194 conveys water from the water inlet 94, or channel 172, to the second control cavity 124 through the channel 176, when in the second pilot position 190. Thus, when the pilot piston 160 is in the second pilot position 190, water flows in the water inlet 94, through the channel 172, into the pilot cavity 168, through the second pilot channel 194, through the channel 176, and to the second control cavity 124. The pressurized water in the control cavities 122 and 124 acts on the first and second surfaces 126 and 128 of the control piston 110 to force the control piston 110 into the first and second control positions 130 and 132. Therefore, the pilot piston 160 and pilot channels 192 and 194 control the position of the control piston 110 by alternately conveying water into the first and second control cavities 122 and 124.

The pilot channels 192 and 194 may be passages extending through the pilot piston 160, as shown. Alternatively, the pilot channels 192 and 194 may be annular grooves formed about the longitudinal axis of the pilot piston 160. The pilot channels 192 and 194 are examples of pilot channel means for conveying or directing water from the inlet 94 to the control cavity. Any pilot channel means may be used to direct the water. It is understood that the pilot channels may take various forms or shapes.

The valve housing 90 also has first and second pressure passages 200 and 202 formed therein for communicating pressure. The first pressure passage 200 extends between the first water opening 98 and the first pilot cavity 180 to communicate the water pressure from the first water opening 98, and thus the first chamber 82, to the first surface 126 of the pilot piston 160. Similarly, the second pressure passage 202 extends between the second water opening 100 and the second pilot cavity 182 to communicate the water pressure from the second water opening 100, and thus the second chamber 84, to the second surface 128 of the pilot piston 160. Thus, the pressure of the water at the first and second water openings 98 and 100, or the first and second chambers 82 and 84, acts on the first and second surfaces 126 and 128 of the pilot piston 160 to force the pilot piston 160 into the first and second pilot positions 188 and 190, respectively. It is understood that the pressure of the water at the water opening, and thus in the chambers, will alternate as the valve alternately directs pressurized water and exhausts the chambers.

Figure 10:
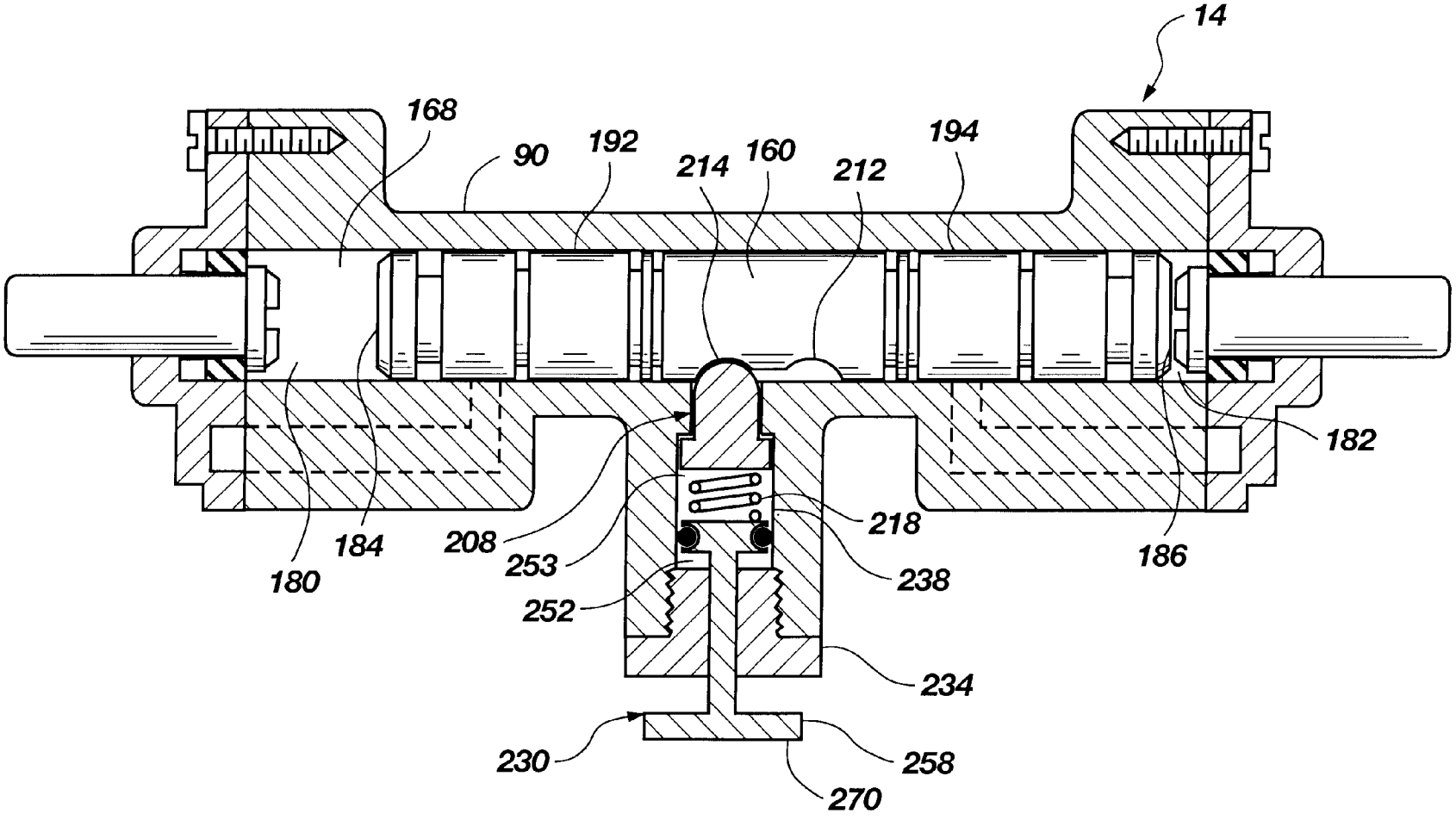
FIG. 10 is a bottom, cross-sectional view of the adjustable valve of FIG. 8, taken along section 10—10.

Referring to FIG. 10, a two-position detent 208 is disposed in or coupled to the valve housing 90 and engages one of two indentations, or first and second indentations 212 and 214, formed in the pilot piston 160. Each indentation 212 and 214 corresponds to one of the first or second pilot positions 188 and 190. For example, the detent 208 engages the first indentation 212 when the pilot piston 160 is in the first pilot position 188 and engages the second indentation 214 when in the second pilot position 190. The detent 208 may be a ball, pin, or the like.

A spring 218 is disposed in the valve housing 90 and engaging the detent 208 to bias the detent 208 into one of the two indentations 212 and 214. The detent 208 and spring 218 apply an amount of resistance to the movement of the pilot piston 160 between the first and second position 188 and 190. Thus, the water pressure acting on the first and second surfaces 184 and 186, and developed at the first and second water openings 98 and 100, must reach a certain threshold pressure to overcome the amount of resistance applied by the detent 208 and spring 218. The threshold pressure is preferably associated with the end of travel of the drive piston 74 in the annular chamber 58. It is understood that the pressurized water enters the annular chamber 58 and acts on the drive piston 74 to force the drive piston 74 to slide within the annular chamber 58 in a rotational motion. It is also understood that the pressure of the water is relatively low as the drive piston 74 moves, but increases as drive piston 74 slows or is stopped, either by the end of its travel or by waste lodging between the fixed and pivoting cutters 50 and 54.

The spring 218 is one example of a biasing means for biasing the detent 208 against the pilot piston 160. Any biasing means for biasing the detent 208 may be used, including for example, a resilient member, fluid pressure, etc.

Referring to FIG. 10, the valve 14 of the present invention advantageously has an adjustor 230 or adjustment mechanism for adjusting the amount of resistance applied by the spring 218 and detent 208 to the pilot piston 160. By adjusting the amount of resistance applied by the spring 218 and detent 208, the valve 14, and the apparatus 10, may be adjusted to suit the water pressure available. In addition, the valve 14 and the apparatus 10 may be adjusted to compensate for the different properties of different springs, or to compensate for wear of the springs. Furthermore, the valve 14 and apparatus 10 may be adjusted to obtain the desired torque or cutting power. Therefore, the valve 14 and apparatus 10 of the present invention are more efficient than prior art devices and may operate with any number of environmental conditions.

In the preferred embodiment of the present invention, the adjustor 230 is adapted to adjust the resistance applied by the spring 218 biasing the detent 208 against the pilot piston 160. The adjustor 230 preferably adjusts the resistance by adjusting the bias force applied by the spring 218 to the detent 208. The adjustment advantageously is accomplished by varying the amount of compression of the spring 218, or by varying the length of a cavity in which the spring is disposed.

In operation, the apparatus 10 is disposed under a sink 20 and the valve 14 coupled to a source of pressurized water as discussed above, as shown in FIG. 1. Reference will now be made to FIG. 5*a*. Assume that the initial status of the valve 14 is with the control piston 110 in the first control position 130, or to the left of the control cavity 114, and the pilot piston 160 is in the first pilot position 188, or to the left of the pilot cavity 168. In addition, assume the detent 208 is engaging the second indentation 214 of the pilot piston.

The pressurized water enters the valve housing 90 through the water inlet 94. The pressurized water enters the control cavity 114 where it is directed by the control piston 110 out of the first water opening 98 in the valve housing 90, but into the first water opening 62 of the apparatus housing 18. The floating seal 156 prevents water from leaking between the piston 110 and cavity 114.

The pressurized water enters the first chamber 82 of the annular chamber 58 where it acts on the drive piston 74 to force the drive piston 74 to slide or move withing the annular chamber 58 in a rotational motion, or counter-clockwise.

In addition, any water in the second chamber 84 of the annular chamber 58, or exhaust water, is forced out through the second water opening 64 of the apparatus housing 18, but into the second water opening 100 of the valve housing 90, by the drive piston 74. The exhaust water enters the control cavity 114 where it is directed by the control piston 110 out of the second exhaust opening 142 and into the waste passage 30.

Meanwhile, the pressurized water also enters the pilot cavity 168. The pilot piston 160 directs the pressurized water into the second cavity 124 of the control cavity 114. As shown in FIGS. 9*a* and 9*b*, the water passage 134 allows the water in between the ends of the control piston and control cavity. The pressurized water acts on the second surface 128 of the control piston 110 to force the control piston 110 to the first control position 130, or to the left.

In addition, the pressure of the water at the first water opening 98 of the valve housing 90, and thus at the first chamber 62, is communicated by the first pressure passage 200 to the first cavity 180 of the pilot cavity 168. The water pressure acts against the first surface 184 of the pilot piston 160. Initially, the spring 218 biases the detent 208 against the second indentation 214, maintaining the pilot piston 160 in the first pilot position 188 despite the force of the water. Eventually, however, the pressurized water in the first chamber 62 forces the drive piston 74 through the length of the annular chamber where it abuts the plug 68, defining an end of travel. As the drive piston 74 stops moving, water pressure builds up in the first chamber 62 and is communicated to the first pilot cavity 180. The water pressure now reaches a certain threshold amount in which it acts against the pilot piston 160 with enough force to overcome the amount of resistance applied by the spring 218 and detent 208. The water pressure now forces the pilot piston 160 into the second pilot position 190, or to the right of the pilot cavity 168.

Reference will now be made to FIG. 5*b*, with the pilot piston 160 in the second pilot position 190, the pressurized water enters the pilot cavity 168 where it is directed by the pilot piston 160 to the first cavity 122 of the control cavity 114. Again, the water passage 134 allows the water between the ends of the piston and cylinder, as shown in FIGS. 9*a* and 9*b*. The pressurized water acts against the first surface 126 of the control piston to force the control piston into the second control position 132, or to the right of the control cavity 114.

With the control piston 110 in the second control position 132, the pressurized water enters the control cavity 114 where it is directed by the control piston 110 out of the second water opening 100 in the valve housing 90, but into the second water opening 64 of the apparatus housing 18. Again, the floating seal 156 prevents water from leaking between the piston and cylinder. The pressurized water enters the second chamber 84 of the annular chamber 58 where it acts on the drive piston 74 to force the drive piston 74 to slide or move withing the annular chamber 58 in a rotation motion, or clockwise.

In addition, any water in the first chamber 82 of the annular chamber 58, or exhaust water, is forced out through the first water opening 62 of the apparatus housing 18, but into the first water opening 98 of the valve housing 90, by the drive piston 74. The exhaust water enters the control cavity 114 where it is directed by the control piston 110 out of the first exhaust opening 140 and into the waste passage 30.

The pressure of the water at the second water opening 100 of the valve housing 90, and thus at the second chamber 64, is communicated by the second pressure passage 202 to the second cavity 182 of the pilot cavity 168. The water pressure acts against the second surface 186 of the pilot piston 160. Initially, the spring 218 biases the detent 208 against the first indentation 212, maintaining the pilot piston 160 in the second pilot position 190 despite the force of the water. Eventually, however, the pressurized water in the second chamber 64 forces the drive piston 74 through the length of the annular chamber where it abuts the plug 68, defining an end of travel. As the drive piston 74 stops moving, water pressure builds up in the second chamber 64 and is communicated to the second pilot cavity 182. The water pressure now reaches a certain threshold amount in which it acts against the pilot piston 160 with enough force to overcome the amount of resistance applied by the spring 218 and detent 208. The water pressure now forces the pilot piston 160 into the first pilot position 188, or to the left of the pilot cavity 168.

This process repeats causing the drive piston 74 to reciprocate in the annular chamber 58, and thus causing the pivoting cutter 54 to reciprocate in a rotational or pivotal motion. The pressure in the annular chamber 58 causes the pilot piston 160 to shift back and forth, which in turn causes the control piston 110 to shift back and forth, which in turn causes the drive piston 74 to reciprocate.

The adjustor 230 may be used to adjust the threshold water pressure required to shift the pilot piston 160, and thus shift the control piston 110 and reciprocate the drive piston 74 and cutter 54. In addition, the adjustor 230 may be used to adjust the torque or rotational force exerted by the drive piston 74 and cutter 54. By advancing and retracting the threaded member 258, the amount of compression of the spring 218 is adjusted, and thus the amount of biasing force exerted by the spring 218 is adjusted.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A valve for a water driven waste disposal apparatus driven by pressurized water and having a reciprocating drive piston slidably disposed in an annular drive chamber and coupled to cutting means for cutting waste, the annular chamber having first and second water openings formed therein on opposite sides of the drive piston, the valve comprising:

a valve housing having an inlet for receiving the pressurized water, first and second openings for coupling to the first and second water openings of the annular chamber respectively, a control cylinder with opposite ends including a first control cylinder end and a second control cylinder end, a pilot cavity with opposite ends, and channel means for conveying the pressurized water through the housing from the inlet to the control cylinder and pilot cavity, from the control cylinder to the first and second openings, and from the pilot cavity to the control cylinder;

a reciprocating control piston slidably disposed in the control cylinder between a first and a second control positions, the control piston dividing the control cylinder into first and second control cylinders, the control piston having a first control piston end in communication with the first cylinder and a second control piston end in communication with the second cylinder, the control piston having control channel means formed therein for (i) conveying water from the inlet to the first water opening when in the first position, and (ii) conveying water from the inlet to the second water opening when in the second position;

a reciprocating pilot piston slidably disposed in the pilot cavity between first and second pilot positions, the pilot piston dividing the pilot cavity into first and second pilot cavities, the pilot piston having a first surface in communication with the first cavity and a second surface in communication with the second cavity, the pilot piston having pilot channel means formed therein for (i) conveying water from the inlet to the second control cylinder when in the first pilot position to force the control piston into the first control position, and (ii) conveying water from the inlet to the first control cylinder when in the second pilot position to force the control piston into the second control position;

the water channel means including first and second passageways formed in the housing, the first passageway extending between the first opening and the first pilot cavity so that the water pressure acts on the first surface of the pilot piston to force the pilot piston into the second pilot position, the second passageway extending between the second opening and the second pilot cavity so that the water pressure acts on the second surface of the pilot piston to force the pilot piston into the first position;

resistance means disposed in the housing and engaging the pilot piston for applying an amount of resistance to the movement of the pilot piston between the first and second pilot positions such that water pressure at the first and second openings must reach a threshold pressure in order to overcome the amount of resistance applied by the resistence means to the pilot piston;

water passage means disposed between the first and second control piston ends and the first and second control cylinder ends, respectively, for preventing flush abutment between the first control piston end and the first control cylinder end, and between the second control piston end and the second control cylinder end for creating a water passage for water to enter between the first and second control piston ends and the first and second control cavity ends.

2. The valve of claim 1, wherein the water passage means comprises a first indentation formed in the first control piston end and a second indentation formed in the second control piston end.

3. The valve of claim 1, wherein the water passage means comprises a first indentation formed in the first control cylinder end and a second indentation formed in the second control cylinder end.

4. The valve of claim 1, wherein the water passage means comprises a first protrusion formed in the first control piston end and a second protrusion formed in the second control piston end.

5. The valve of claim 1, wherein the water passage means comprises a first protrusion formed in the first control cylinder end and a second protrusion formed in the second control cylinder end.

6. The valve of claim 1, wherein the valve housing further comprises first and second exhaust openings formed therein in fluid communication with the control cylinder; and wherein the control piston has a first exhaust channel formed therein for conveying water from the first water opening to the first exhaust opening when in the second control position, and a second exhaust channel formed therein for conveying water from the second water opening to the second exhaust opening when in the first control position.

7. A water powered waste disposal apparatus, comprising:

a housing having a waste inlet, an outlet, a passage extending therebetween, and an annular chamber formed about the passage and having a first and second water openings formed therein and extending into the annular chamber;

at least one pivoting cutter pivotally disposed in the passage for cutting the waste;

a reciprocal drive piston slidably disposed in the annular chamber and coupled to the at least one pivoting cutter, the drive piston having opposite sides;

a control valve for supplying water alternately to the first and second water openings to drive the drive piston, and thus the at least one cutter, in a reciprocating rotational motion, the control valve having a control cylinder formed therein with opposite first and second ends, an inlet for receiving the water, and first and second openings coupled to the first and second water openings of the housing;

a reciprocating control piston slidably disposed in the control cylinder dividing the control cylinder into first and second cylinders and having opposite first and second ends and control channel means formed therein for directing water from the inlet to the first or second openings, and thus the opposite sides of the drive piston;

a reciprocating pilot piston slideably disposed in the valve and having opposite sides and pilot channel means formed therein for alternately directing water from the inlet to the first and second control cylinders to cause the control piston to reciprocate;

the valve having passageways formed therein and extending from the first and second water openings to the opposite sides of the pilot piston for communicating water pressure from the annular chamber to the pilot piston to reciprocate the pilot piston;

resistance means engaging the pilot piston for applying an amount of resistance to the movement of the pilot piston such that water pressure at the first and second openings must reach a threshold pressure in order to overcome the amount of resistance applied by the resistence means to the pilot piston;

water passage means disposed between the first and second ends of the control piston and the first and second ends of the control cylinder, respectively, for preventing flush abutment between the first end of the control piston and the first end of the control cylinder, and between the second end of the control piston and the second end of the control cylinder for creating a water passage for water to enter between the first and second ends of the control piston and the first and second ends of the control cavity respectively.

8. The disposal apparatus of claim 7, wherein the water passage means comprises a first indentation formed in the first control piston end and a second indentation formed in the second control piston end.

9. The disposal apparatus of claim 7, wherein the water passage means comprises a first indentation formed in the first control cylinder end and a second indentation formed in the second control cylinder end.

10. The disposal apparatus of claim 7, wherein the water passage means comprises a first protrusion formed in the first control piston end and a second protrusion formed in the second control piston end.

11. The disposal apparatus of claim 7, wherein the water passage means comprises a first protrusion formed in the first control cylinder end and a second protrusion formed in the second control cylinder end.

12. The disposal apparatus of claim 7, wherein the valve further comprises first and second exhaust openings formed therein in fluid communication with the control cylinder; and wherein the control piston has a first exhaust channel formed therein for conveying water from the first water opening to the first exhaust opening when in the second control position, and a second exhaust channel formed therein for conveying water from the second water opening to the second exhaust opening when in the first control position.

13. A valve for a water driven waste disposal apparatus driven by pressurized water and having a reciprocating drive piston slidably disposed in an annular drive chamber and coupled to cutting means for cutting waste, the annular chamber having first and second water openings formed therein on opposite sides of the drive piston, the valve comprising:

a valve housing having an inlet for receiving the pressurized water, first and second openings for coupling to the first and second water openings of the annular chamber respectively, a control cylinder with a cylindrical control cylinder wall and opposite ends including a first control cylinder end and a second control cylinder end, a pilot cavity with opposite ends, and channel means for conveying the pressurized water through the housing from the inlet to the control cylinder and pilot cavity, from the control cylinder to the first and second openings, and from the pilot cavity to the control cylinder;

a reciprocating control piston slidably disposed in the control cylinder between a first and a second control positions, the control piston dividing the control cylinder into first and second control cylinders, the control piston having a first control piston end in communication with the first cylinder and a second control piston end in communication with the second cylinder;

control channel means formed in the control piston for (i) conveying water from the inlet to the first water opening when in the first position, and (ii) conveying water from the inlet to the second water opening when in the second position, the control channel means comprising a pair of spaced apart, annular damn portions formed on the control piston and extending radially from the control piston towards the control cylinder wall, and a channel disposed between the pair of damn portions, the damn portions including first and second damn portions, each damn portion having an annular groove formed therein including first and second grooves;

first and second annular, floating seals disposed in the first and second annular grooves, respectively, to prevent water from escaping from the groove and past the dam portions, each seal having a cut formed therethrough for allowing the seals to expand;

a reciprocating pilot piston slidably disposed in the pilot cavity between first and second pilot positions, the pilot piston dividing the pilot cavity into first and second pilot cavities, the pilot piston having a first surface in communication with the first cavity and a second surface in communication with the second cavity, the pilot piston having pilot channel means formed therein for (i) conveying water from the inlet to the second control cylinder when in the first pilot position to force the control piston into the first control position, and (ii) conveying water from the inlet to the first control cylinder when in the second pilot position to force the control piston into the second control position;

the water channel means including first and second passageways formed in the housing, the first passageway extending between the first opening and the first pilot cavity so that the water pressure acts on the first surface of the pilot piston to force the pilot piston into the second pilot position, the second passageway extending between the second opening and the second pilot cavity so that the water pressure acts on the second surface of the pilot piston to force the pilot piston into the first position;

resistance means disposed in the housing and engaging the pilot piston for applying an amount of resistance to the movement of the pilot piston between the first and second pilot positions such that water pressure at the first and second openings must reach a threshold pressure in order to overcome the amount of resistance applied by the resistence means to the pilot piston.

14. The disposal apparatus of claim 13, wherein slots formed in the floating seals are formed at an angle of approximately 41 degrees.

15. The disposal apparatus of claim 13, further comprising water passage means disposed between the first and second control piston ends and the first and second control cylinder ends, respectively, for preventing flush abutment between the first control piston end and the first control cylinder end, and between the second control piston end and the second control cylinder end for creating a water passage for water to enter between the first and second control piston ends and the first and second control cavity ends.

16. The disposal apparatus of claim 15, wherein the water passage means comprises a first indentation formed in the first control piston end and a second indentation formed in the second control piston end.

17. The disposal apparatus of claim 15, wherein the water passage means comprises a first indentation formed in the first control cylinder end and a second indentation formed in the second control cylinder end.

18. The disposal apparatus of claim 15, wherein the water passage means comprises a first protrusion formed in the first control piston end and a second protrusion formed in the second control piston end.

19. The disposal apparatus of claim 15, wherein the water passage means comprises a first protrusion formed in the first control cylinder end and a second protrusion formed in the second control cylinder end.

20. The disposal apparatus of claim 13, wherein the valve further comprises first and second exhaust openings formed therein in fluid communication with the control cylinder; and wherein the control piston has a first exhaust channel formed therein for conveying water from the first water opening to the first exhaust opening when in the second control position, and a second exhaust channel formed therein for conveying water from the second water opening to the second exhaust opening when in the first control position.

21. A water powered waste disposal apparatus, comprising:

a housing having a waste inlet, an outlet, a passage extending therebetween, and an annular chamber formed about the passage and having a first and second water openings formed therein and extending into the annular chamber;

at least one pivoting cutter pivotally disposed in the passage for cutting the waste;

a reciprocal drive piston slidably disposed in the annular chamber and coupled to the at least one pivoting cutter, the drive piston having opposite sides;

a control valve for supplying water alternately to the first and second water openings to drive the drive piston, and thus the at least one cutter, in a reciprocating rotational motion, the control valve having a control cylinder formed therein with a cylindrical control cylinder wall and opposite first and second ends, an inlet for receiving the water, and first and second openings coupled to the first and second water openings of the housing;

a reciprocating control piston slidably disposed in the control cylinder dividing the control cylinder into first and second cylinders and having opposite first and second ends;

control channel means formed in the reciprocating control piston for directing water from the inlet to the first or second openings, and thus the opposite sides of the drive piston, the control channel means comprising a pair of spaced apart, annular damn portions formed on the control piston and extending radially from the control piston towards the control cylinder wall, and a channel disposed between the pair of damn portions, the damn portions including first and second damn portions, each damn portion having an annular groove formed therein;

first and second annular, floating seals disposed in the first and second annular grooves, respectively, to prevent water from escaping from the groove and past the dam portions, each seal having a slot formed therethrough for allowing the seals to expand;

a reciprocating pilot piston slideably disposed in the valve and having opposite sides and pilot channel means formed therein for alternately directing water from the inlet to the first and second control cylinders to cause the control piston to reciprocate;

the valve having passageways formed therein and extending from the first and second water openings to the opposite sides of the pilot piston for communicating water pressure from the annular chamber to the pilot piston to reciprocate the pilot piston;

resistance means engaging the pilot piston for applying an amount of resistance to the movement of the pilot piston such that water pressure at the first and second openings must reach a threshold pressure in order to overcome the amount of resistance applied by the resistence means to the pilot piston.

22. The disposal apparatus of claim 21, wherein the slots formed in the floating seals are formed at an angle of approximately 41 degrees.

23. The disposal apparatus of claim 21, further comprising water passage means disposed between the first and second ends of the control piston and the first and second ends of the control cylinder, respectively, for preventing flush abutment between the first end of the control piston and the first end of the control cylinder, and between the second end of the control piston and the second end of the control cylinder for creating a water passage for water to enter between the first and second ends of the control piston and the first and second ends of the control cavity respectively.

24. The disposal apparatus of claim 23, wherein the water passage means comprises a first indentation formed in the first control piston end and a second indentation formed in the second control piston end.

25. The disposal apparatus of claim 23, wherein the water passage means comprises a first indentation formed in the first control cylinder end and a second indentation formed in the second control cylinder end.

26. The disposal apparatus of claim 23, wherein the water passage means comprises a first protrusion formed in the first control piston end and a second protrusion formed in the second control piston end.

27. The disposal apparatus of claim 23, wherein the water passage means comprises a first protrusion formed in the first control cylinder end and a second protrusion formed in the second control cylinder end.

* * * * *